United States Patent [19]

Lu

[11] Patent Number: 4,550,776

[45] Date of Patent: Nov. 5, 1985

[54] INCLINED RADIALLY LOUVERED FIN HEAT EXCHANGER

[76] Inventor: James W. B. Lu, 5868 Oxford Dr., Greendale, Wis. 53129

[21] Appl. No.: 497,661

[22] Filed: May 24, 1983

[51] Int. Cl.[4] ..... F28F 1/32

[52] U.S. Cl. ..... 165/151

[58] Field of Search ..... 165/151, 152, 153

[56] References Cited

U.S. PATENT DOCUMENTS

| | | | |
|---|---|---|---|
| 1,416,570 | 5/1922 | Modine | 165/151 |
| 2,246,258 | 6/1941 | Lehman | 165/151 X |
| 3,135,320 | 6/1964 | Forgo | 165/181 X |
| 3,438,433 | 4/1969 | Gunter | 165/151 |
| 3,631,922 | 1/1972 | Ponziani | 165/151 |
| 3,759,050 | 9/1973 | Slaasted et al. | 165/151 X |
| 3,916,989 | 11/1975 | Harada et al. | 165/151 |
| 4,023,618 | 5/1977 | Kun et al. | 165/152 |
| 4,141,411 | 2/1979 | Kalnin et al. | 165/151 |
| 4,300,629 | 11/1981 | Hatada et al. | 165/151 |
| 4,311,193 | 1/1982 | Verhaeghe et al. | 165/153 |
| 4,332,293 | 6/1982 | Hiramatsu | 165/153 |
| 4,365,667 | 12/1982 | Hatada et al. | 165/152 |
| 4,434,844 | 3/1984 | Sakitani et al. | 165/151 |
| 4,449,581 | 5/1984 | Blystone et al. | 165/151 |
| 4,469,167 | 9/1984 | Itoh et al. | 165/151 |

FOREIGN PATENT DOCUMENTS

| | | | |
|---|---|---|---|
| 236342 | 5/1960 | Australia . | |
| 0079090 | 5/1983 | European Pat. Off. | 165/151 |
| 0025694 | 3/1981 | Japan | 165/151 |
| 0023699 | 3/1981 | Japan | 165/151 |
| 0192795 | 11/1982 | Japan | 165/151 |
| 0192794 | 11/1982 | Japan | 165/151 |
| 340765 | 12/1929 | United Kingdom . | |
| 2027533A | 2/1980 | United Kingdom | 165/151 |

*Primary Examiner*—Sheldon J. Richter
*Assistant Examiner*—Randolph A. Smith
*Attorney, Agent, or Firm*—Hubbard, Thurman, Turner & Tucker

[57] ABSTRACT

An improved louver pattern for fins of a tube and fin type heat exchanger, in which groups of louvers are formed radially with respect to the tubes, extending from each tube to adjacent tubes. Each louver group consists of a plurality of parallel slits in the fin extending in the radial direction, and defining elongate rectangular portions of the fin therebetween, which are twisted at an angle to form inclined louvers in an otherwise generally planar fin. The louver groups thus formed provide improved turbulence and mixing to break up the viscous or boundary layer of flow across the fin, and to create turbulence and vorticity to further improve mixing of the fluid and heat transfer.

1 Claim, 4 Drawing Figures

INCLINED RADIALLY LOUVERED FIN HEAT EXCHANGER

TECHNICAL FIELD OF THE INVENTION

This invention relates to tube and fin type heat exchangers, and specifically to improvements in louver patterns for the fins for improving heat transfer efficiency.

BACKGROUND OF THE INVENTION

Tube and fin type heat exchangers are widely used in a number of industries in a wide variety of different applications. Such heat exchangers generally consist of a number of parallel tubes having a plurality of closely spaced heat conductive fin members positioned transversely across them with tubes passing through holes in the fins and contacting the fins in heat conducting relationship. A first fluid is caused to be circulated through the tubes, either in a single parallel flow pass, or, through the use of suitable return bends, through one or more return passes. A second fluid is directed to flow along and between the fins and around the tubes in heat conducting relationship to the tubes and fins. Single or multiple passes of the second fluid medium can be provided through the use of baffles as is well known. The physical dimensions and choice of materials depend, of course, on the specific application for the heat exchanger, including type of fluid, i.e. oil, water, refrigerant, air, etc., temperature and pressure range and difference requirements and the like. The fins are secured to the tubes, for example, by metallurgical bonding or by expansion of the tubes after insertion through the apertures provided in the fins, so as to create good thermal contact and heat transfer so that the fins act to increase the surface area of the tubes to increase heat transfer.

Heat transfer efficiency is diminished in such heat exchangers because the second fluid medium flowing along the fins tends to build up boundary or viscous layers adjacent the fins. The viscous layer starts at the leading edge of a fin and tends to grow in thickness as the fluid moves across the fin. The viscous layer tends to act as a heat insulation barrier, degrading performance. The longer the flow path, the thicker the boundary layer and the poorer the performance. Various types of patterns have been applied to the fins in the prior art to increase heat transfer such as projections, indentations and undulations, and various types of openings such as slits, louvers, and holes. Regardless of the particular shape, a primary purpose of the patterns is to break up the boundary or viscous layer and promote some turbulence to aid in heat transfer without building up excessive amounts of pressure drop. Some such techniques have succeeded better than others, and the test for whether a particular pattern is better than others depends in many cases on the parameters of the specific application in terms of types of fluid, temperature and pressure differences, and the flow rates of the two fluids. Thus there is not a universally recognized best tube and heat exchanger construction or patterned fins therefor.

Despite progress that has been made in the field, there is always incentive for further improvement, because an increase in heat transfer efficiency translates into a savings in cost of material for a given heat exchanger or reduces operating pressure drop which results in a savings of power for associated equipment, both of which in turn result in greater economies. Improvements of even small percentages in overall efficiencies can lead to significant manufacturing and operational savings.

This invention provides a new fin pattern for a fin and tube heat exchanger providing improved heat exchange efficiency with minimal increase in pressure drop for certain types of applications. The heat exchanger of this invention has been found to provide significant improvements as applied to an engine aftercooler or intercooler in which hot air directed across and through the fins is cooled by liquid circulated through the tubes. In addition, the invention is useful in related types of heat exchangers.

SUMMARY OF THE INVENTION

According to one aspect of the invention, an improved tube and fin type heat exchanger is provided comprising a plurality of parallel heat exchange tubes having a plurality of closely spaced parallel generally planar heat exchange fins positioned thereon generally transversely of the tubes, with the fins having corresponding holes through which the tubes pass and contact the fins in good heat conducting relationship. The fins have a plurality of angled louver patterns extending in a direction from each tube towards each adjacent tube so as to form a number of said angled louver patterns extending radially from each tube. Each angled louver pattern comprises a plurality of parallel slits formed in the heat exchanger fin extending in the direction from one tube towards the other, but not extending all the way to either tube, with elongate rectangular areas defined between the slits. These elongate rectangular areas are twisted so as to be inclined at an acute angle to the plane of the fin. These inclined louvers intercept and break up the boundary layer of fluid flowing along the fin and create turbulence and mixing of fluid from one side of the fin to the other to increase the heat exchange efficiency.

The successive louvers in a group continuously interrupt the growth of the boundary layer and force it to rebuild from a new begining at each louver to keep the average boundary layer relatively thin. A single louver instead of a group of louvers would interrupt the boundary layer less frequently and as a result the layer would grow thicker and the performance would become less efficient. The inclination of the louvers also generates turbulence and vorticity to further improve heat transfer efficiency in addition to creating mixing of the fluid.

According to a preferred form of the invention, each angled louver pattern consists of several parallel slits with the intervening elongate strips of the fin being twisted so as to provide a leading edge above the plane of the fin and a trailing edge below it on the other side thereof. Alternating groups of louvers around a tube can be twisted in opposite sense, i. e. leading edge below the plane of the fin, etc., to further mix the flow across the fins.

DETAILED DESCRIPTION OF THE PREFERRED EMBODIMENT

Figure 1:
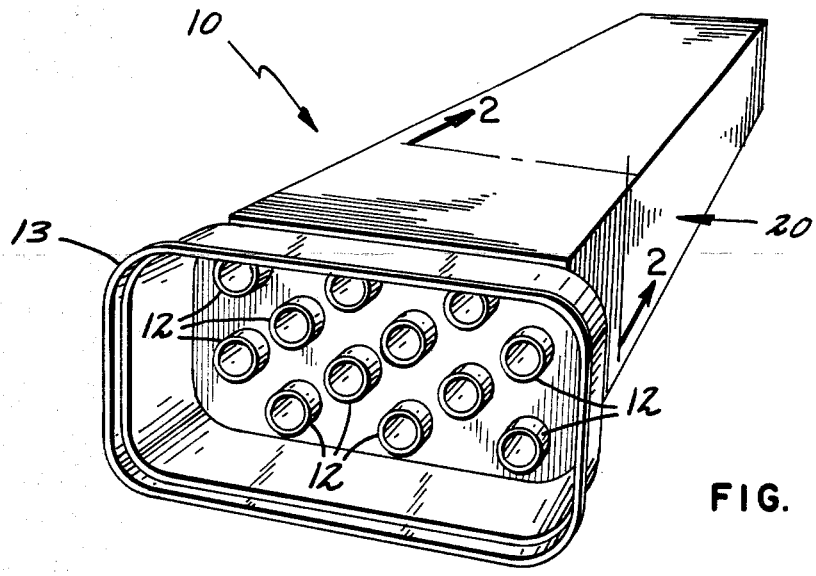
FIG. 1 is a perspective view of a tube and fin heat exchanger assembly according to the present invention which could be used as the core for a heat exchanger.

Referring now to drawings, like reference numerals designate identical or corresponding parts throughout the several views.

In FIG. 1, reference number 10 generally designates a tube and fin type heat exchanger assembly in which the present invention can be used. The particular assembly shown in FIG. 1 comprises twelve tubes (all designated by reference number 12) which are positioned parallel to one another and extend through the core assembly. A great number of generally planar heat exchanger fins, designated by reference number 20, are positioned transversely of tubes 12 and spaced closely together to form passages therebetween for the second heat exchange medium. A suitable manifold indicated by reference number 13 would be applied at either end and a suitable box, shell or other container (not shown) would be placed around the fin section so that appropriate connections can be made to direct the first fluid to the tubes 12, and the second fluid to, along and between the fins 20. For example, for use as a heat exchanger core for an engine intercooler or aftercooler, air from the turbocharger would be passed through the fins 20, and cooling water would be passed through tubes 12.

Figure 2:
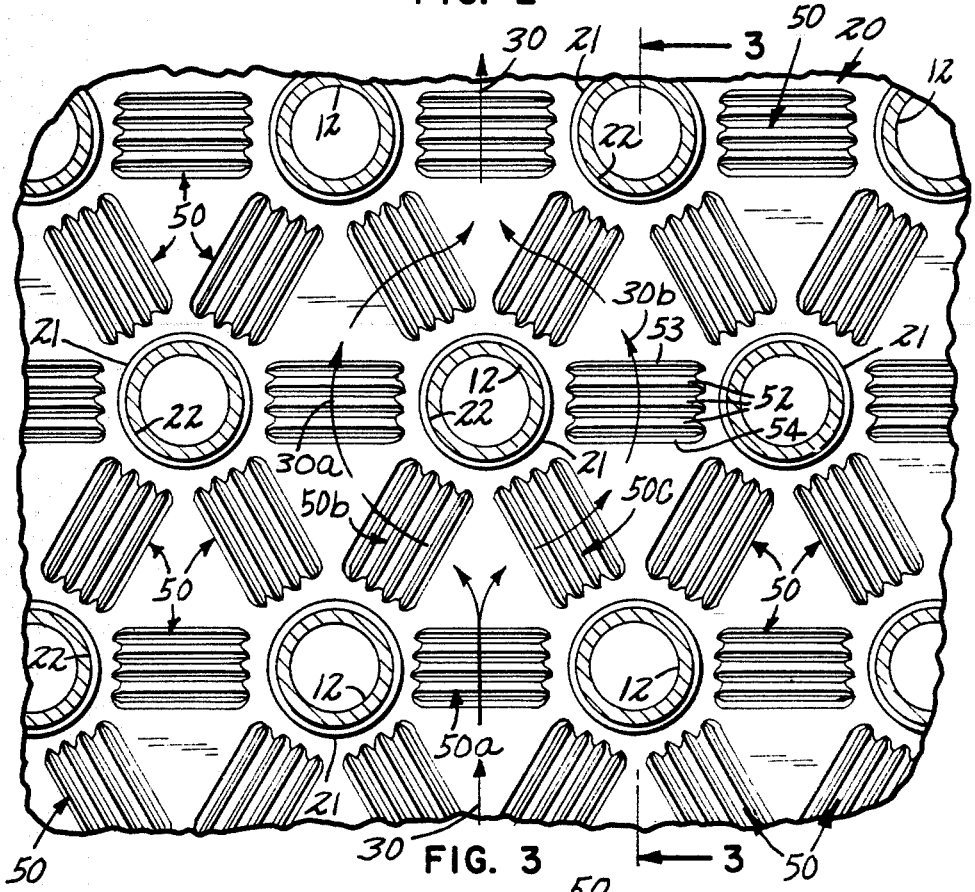
FIG. 2 is an enlarged sectional view as seen generally from the line 2—2 of FIG. 1, showing one of the fins in plan.

Referring now to FIG. 2, in which a fin is seen in plan view, reference number 12 again refers to the heat exchanger tubes, which are seen in cross section. Fin 20 has a plurality of tube holes 22 formed therein to receive the tubes, each having a flange portion 21, also seen in FIG. 3, formed around each hole to form the dual function of providing increased contact area with the tube and providing the desired pitch, or spacing between adjacent fins. The tube holes 22 in the preferred embodiment are arranged in rows, three of which are shown, with the rows offset from adjacent rows so that with respect to a direction of fluid flow 30, tubes in successive rows are alternately spaced rather than being positioned one behind the other.

Groups of inclined or angled louver patterns 50 according to this invention are provided adjacent each tube and extending toward adjacent tubes. Thus, for each tube 12 for the configuration shown in FIG. 2, there are six groups of inclined or angled louvers 50 extending radially from each tube toward the tube next adjacent it in each of six directions. This of course might not apply for the end row of tubes (not shown) in which case louver groups might not extend from such tubes to the edge of the fin.

Figure 4:
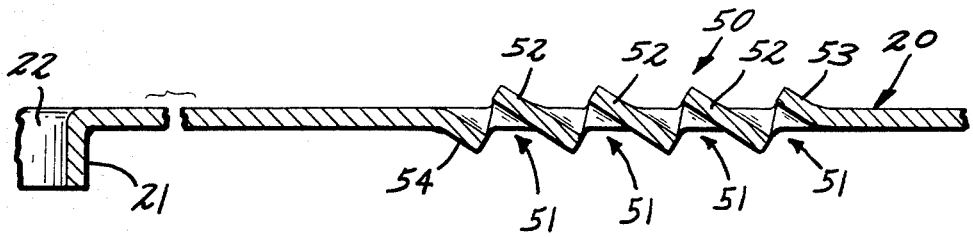
FIG. 4 is a greatly enlarged sectional view of a portion of a fin showing a tube hole and one adjacent louver pattern.
Figure 3:
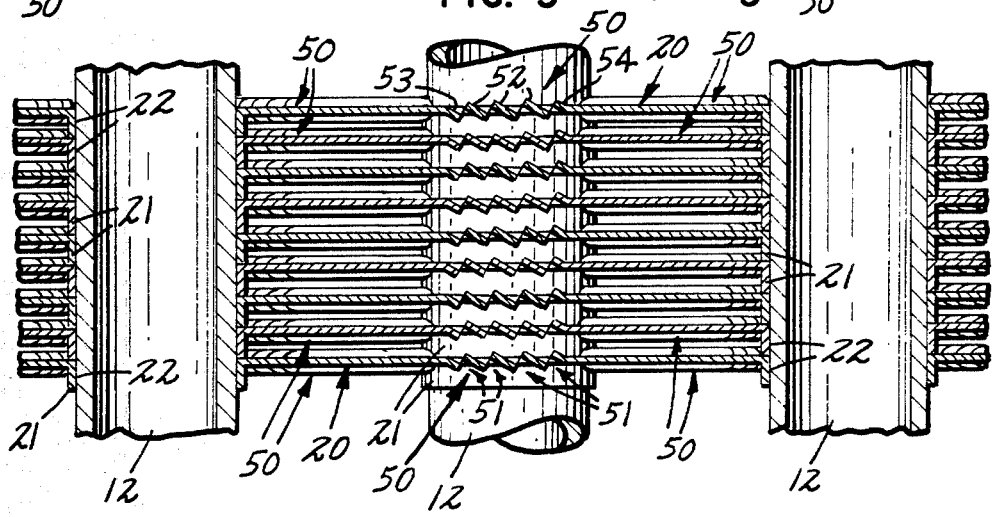
FIG. 3 is a further enlarged sectional view as seen generally from line 3—3 of FIG. 2.

As seen in FIGS. 2, 3 and especially in FIG. 4, each group 50 of angled louvers comprises a plurality of parallel slits 51 of which there are four in each group in the embodiment shown, although the number of slits can be varied for different applications. Slits 51 are parallel to each other and run in a direction between adjacent tubes 12, but the slits stop short of the flange portion 21. The slits define a number of parallel, elongate rectangular strips 52 therebetween. These strips are twisted or inclined at an acute angle to the plane of the fin, with one edge thereof being twisted above the plane of the fin and the other edge thereof being twisted below the plane of the fin. In addition, portions 53 and 54 of the fin adjacent the first and last slits in a group are bent upward and downward at the same angle to compliment and complete the louver pattern. Preferably each of the strips 52 within a group are twisted in the same direction and by the same amount, so that their leading edges extend beyond the plane of the fin so as to intercept a portion of the flow along the fin, break up the boundary or viscous layers and create beneficial turbulence and mixing. While the strips 52 in a single group are preferably twisted in the same direction, the strips of successively alternating groups can be given opposite twists, that is, one group can have its leading edges, with respect to the direction of fluid flow, above the plane of the fin, and the next group can have its leading edges twisted through the opposite angle to be below the plane of the fin. It will be appreciated that the terms "above" and "below" are arbitrary as it is immaterial which way the heat exchanger is oriented for use, and it is understood that those terms are used only for purposes of illustration.

Referring again to FIG. 2, a flow path 30 is indicated by arrows as moving across the plane of the fin. After crossing one louver group **50*a*, flow path 30 splits into paths 30*a* and 30*b* to go around the tube which is directly ahead due to the staggering or offsetting of successive rows. The two paths 30*a* and 30*b* go around a tube, mixing with similar flow paths from other tubes, then rejoin at a downstream point behind a tube to form a single flow path 30 again, and the pattern is repeated throughout across the fin. At each crossing of a louver group 50 some of the boundary layer will be interrupted and passed through to the other side of the fin. As explained above, it is preferable that alternate groups have the louvers twist in the opposite direction so that each successive louver group 50** in a flow path has the louver twist in the opposite direction to bring fluid from the top side of the fin to the bottom or vice versa.

The radial positioning of the louvers has several important advantages including the fact that by placing the slits oriented between tubes, the slits do not cut across the direct heat conduction paths from the elongate strip/louvers to and from the adjoining tubes, and this helps promote heat transfer. Also, the radial orientation keeps the louvers essentially transverse to the flow paths which take a sinuous course across the fin due to the offsetting of adjacent rows of tubes. For the orientation of the fin of FIG. 2 with respect to the assumed flow path 30, it will be appreciated that the areas between adjacent tubes in the same row will experience higher fluid flow velocity than the areas between adjacent tubes in adjoining rows. In other words, fluid flow is faster over the louver groups oriented the same as group **50*a* of FIG. 2 than it is over the louver groups oriented the same as group 50*b* and 50*c* of FIG. 2. After the flow goes between adjacent tubes in the same row across a group 50*a*, it splits in two and experiences a corresponding velocity drop as it goes across groups 50*b* and 50*c*, after which it experiences a velocity increase as flow from another group 50*b* or 50*c* joins it to cross a group 50*a* in the next row, etc. The lower fluid velocity in the area between two rows makes that area inefficient as a heat transfer surface, and more improvement is needed in that area. Conventional louver methods which interrupt heat conduction paths of the fin between adjacent tubes cannot achieve optimal results. A single non-inclined louver in that area does not provide enough intensity to promote needed heat transfer improvement. The present invention provides the greatest improvement. The provision of angled or inclined louver patterns in those positions, 50***b* and 50*c* for the orientation of FIG. 2, create turbulence and disruption of the stagnation layer in the zone where the greatest improvement is needed, thus significantly adding to overall heat exchanger efficiency.

It will be appreciated that the number of slits and louvers and to an extent the positioning thereof can be varied for specific applications within the scope of the invention.

What is claimed is:

1. A tube fin heat exchanger assembly, comprising:

a plurality of parallel, spaced round sectioned tubes extending transversely through holes provided in a plurality of generally planar, spaced parallel fins;

a plurality of louver groups on said fins extending radially from tubes toward adjacent tubes;

said louver groups comprising a plurality of parallel slits formed in said fins extending in a direction generally between adjacent tubes and defining elongate rectangular portions therebetween;

said elongate rectangular portions inclined with respect to the plane of said fin to extend one edge thereof above one side of the fin and the other edge thereof above the other side of the fin to form a group of inclined louvers; and the direction of inclination of said louvers being opposite in alternating groups of said louvers which extend radially outward from each tube.

* * * * *